United States Patent [19]

Leikert et al.

[11] Patent Number: 4,466,363

[45] Date of Patent: Aug. 21, 1984

[54] METHOD OF IGNITING A PULVERIZED COAL ANNULAR BURNER FLAME

[75] Inventors: Klaus Leikert; Sigfrid Michelfelder, both of Gummersbach, Fed. Rep. of Germany

[73] Assignee: L. & C. Steinmüller GmbH, Gummersbach, Fed. Rep. of Germany

[21] Appl. No.: 358,860

[22] Filed: Mar. 17, 1982

Related U.S. Application Data

[63] Continuation-in-part of Ser. No. 176,186, Aug. 7, 1980, abandoned.

[30] Foreign Application Priority Data

Aug. 16, 1979 [DE] Fed. Rep. of Germany ..... 2933040

[51] Int. Cl.[3] ..... F23D 1/00

[52] U.S. Cl. ..... 110/347; 110/264

[58] Field of Search ..... 110/347, 263, 264, 265; 431/2, 9

[56] References Cited

U.S. PATENT DOCUMENTS 4,221,174 9/1980 Smith et al. ..... 110/347 X 4,241,673 12/1980 Smith et al. ..... 110/347

*Primary Examiner*—Edward G. Favors

*Attorney, Agent, or Firm*—Becker & Becker, Inc.

[57] ABSTRACT

A method of ignition of a coal dust annular burner flame having an internal back flow region. The ignition energy is introduced centrally into the internal back flow region of the coal dust annular burner flame, and is delivered entirely or at least partially by a dust-ignition flame. The dust air-dust weight ratio for the dust-ignition flame is smaller than that of the main burner flame, being either 0.5 to 1.0, or 0.2 to 0.5, compared with a ratio of 1.5 to 2.0 for the main burner flame.

7 Claims, 1 Drawing Figure

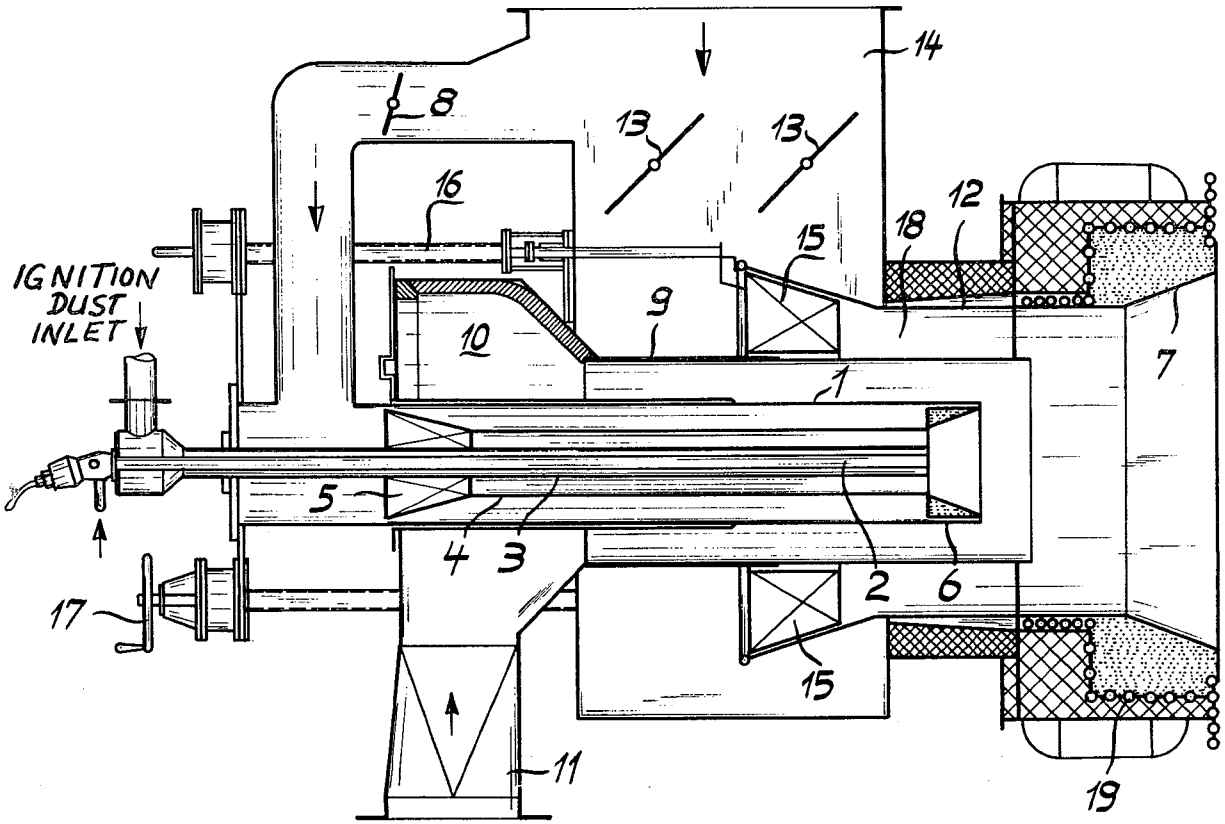
IGNITION
DUST
INLET

METHOD OF IGNITING A PULVERIZED COAL ANNULAR BURNER FLAME

This is a continuation-in-part of co-pending application Ser. No. 176,186-Michelfelder et al filed Aug. 7, 1980, abandoned and replaced by co-pending straight continuation application Ser. No. 396,741-Michelfelder et al filed July 9, 1982 abandoned.

The present invention relates to a method of igniting a coal dust or pulverized coal annular burner flame having an internal back flow region, according to which the ignition energy is introduced centrally into the internal back flow region of the coal dust annular burner flame.

Generally, the igniting energy is supplied to the combustible fuel-air mixture for igniting a burner flame. With coal dust annular burners, the preparation and supply of the ignition energy is effected by so-called ignition burners which are operated with oil or gas. The oil or gas in this connection is ignited by means of an electrical ignition spark. The utilization of oil or gas as an ignition energy carrier is effected with a view to the ignition quality and combustion stability which is necessary, especially with cold combustion chamber influences.

For reasons of cost and availability of reserves, it is increasingly desirable, in place of natural gas or crude oil as an ignition energy carrier, especially with coal dust firing, to utilize coal or another solid fuel as the ignition fuel.

It is, therefore, an object of the present invention to utilize a solid fuel as an ignition energy carrier with coal dust annular burners, i.e. burners having a special construction.

This object, and other objects and advantages of the present invention, will appear more clearly from the following specification in connection with the accompanying drawing, which illustrates a coal-dust annular burner with an ignition or pilot burner which utilizes the inventive procedural principle and is arranged in the burner axis.

The inventive method for igniting a coal-dust annular burner flame having an internal back flow region, according to which the ignition energy is introduced centrally into the internal back flow region, is characterized in that the ignition energy is entirely or at least partially supplied by a dust-ignition flame. It is proposed in accordance with the present invention that the dust air-dust weight ratio for the dust-ignition flame be smaller (0.5 to 1.0) than that of the main burner flame (1.5 to 2.0).

To increase the retention time of the individual dust particles in the ignition region, it is inventively further proposed that the axial combustion-air component for the dust-ignition flame be smaller than that of the main burner flame.

To balance the smaller axial combustion-air component for the dust-ignition flame in relation to the desired resulting combustion-air component, the present invention further provides that the tangential combustion-air component for the dust-ignition flame be greater than that of the main burner flame.

The present inventive method is further characterized in that the dust-ignition flame is operated with a smaller air number ($\lambda=0.8$ to 1.1) than the main burner flame ($\lambda=1.1$ to 1.3).

With the present inventive method there is further provided that the igniter of the ignition burner be operated gas-electrically, oil-electrically, or strictly electrically.

Further provision is made that the ignition burner flame be supplied with combustion air by means of the core-air passage of the main burner.

Additionally, for minimizing the expense, it is proposed that the ignition burner flame be operated with the main fuel. In special situations, where this is necessary for reliable ignition or for ignition stability, a fuel dust differing from the main fuel in granular size and/or consistancy can also be utilized.

If a dust flame, in relation to its ignition quality, evidences a more inactive or slower behavior than the previously utilized gas or oil flames, allowance can be made for this condition with an influencing measure on the ignition burner construction.

It has been discovered that the relative unwillingness of a dust-ignition flame to ignite, and the ignition difficulties connected therewith, can be obviated if the construction principle of the main burner is largely used as the basis for the ignition burner. In accordance with the present inventive method, the burning in the burner principle is expanded to apply to dust-dust flames in the annular burner.

The drawing shows a cross-sectional elevational view of features for solid fuel dust ignition energy supply for igniting a coal dust annular burner flame in accordance with the present invention.

Referring now to the drawing in detail, the round or annular burner, which is operated with powdered coal or coal dust, comprises a central core-air tube 1 which is used for receiving the dust-ignition burner. The dust-ignition burner comprises an ignition-dust tube 3 which is arranged concentrically around an ignition tube 2 and having an ignition dust inlet connection near one end thereof. The ignition-dust tube 3 in turn comprises a mantle-air tube 4 having an axially displaceable twist blade ring or impeller 5 arranged at its air inlet as well as having a conically widening outlet or discharge 6. Regardless of the structural similarity of the ignition burner to the main burner, there are, however, procedurally-specific necessary structural and operating differences.

The structural differences consist in the configuration of the conical ignition burner outlet 6, the conical angle of which is generally greater than the conical angle of the main burner outlet or discharge 7. Furthermore, the ratio of the axial length of the outlet cone to the mantle-air tube diameter is greater (0.75 to 1.5) than the corresponding ratio of the main burner (0.4). Furthermore, with the ignition burner there is locking the core-air tube in view of the production of a rich, and accordingly more willing to ignite, dust-air mixture, A further structural difference exists therein that the ignition-dust flame, after discharge from the burner cone 6, in contrast to the main burner flame, is protected against excessive heat loss by the main burner cone 7, which has an advantageous effect upon the ignition quality and stability.

A procedurally-specific structural feature is also recognizable therein that the combustion air flow for the ignition-dust flame is supplied to the ignition burner by the core-air passage of the main burner, and is controllable by a separate control element independent of the mantle-air flow of the main burner.

The operating differences of the ignition burner compared with the main burner consist in that the dust air-dust weight ratio for enhancing the ignition quality is selected considerably smaller (0.5 to 1.0) than with the main burner (1.5 to 2.0). Furthermore, the dust-ignition flame is operated with a smaller air number ($\lambda=0.8$ to 1.1) than that of the main burner flame ($\lambda=1.1$ to 1.3), with the goal of maintaining the dust-air mixture for the ignition flame in a rich, and accordingly more willing to ignite, range. Furthermore, the combustion air of the main burner is provided with different air speed components; in particular, the axial air speed component is smaller than that of the main burner, whereby the retention time of the fuel dust particles in the ignition region is increased, thereby improving the ignition stability. In contrast, the tangential air speed component, which is adjustable by the twist blade ring or impeller 5, is greater than that of the main burner for the purpose of thereby assuring that the resulting combustion air speed vector, which predominantly influences the turbulence or the mixing procedure, is always maintained in an optimum range.

Additionally, the manner of operation of the ignition burner in special cases can differ from that of the main burner thereby that the ignition burner is operated with a fuel dust which differs from the main fuel in granular size and/or consistency if this is necessary for a reliable ignition and ignition stability.

The main burner, aside from a core-air tube 1 with a controllable air supply 8, also comprises a coaxially arranged dust-laden air tube 9 which is connected with a dust-distributing chamber 10 on the dust conduit 11. A mantle-air tube 12 is arranged coaxially around the dust-ladenair tube 9; the mantle-air tube 12 is connected by flaps or deflectors 13 with the main-air passage 14. A twist blade ring or impeller 15, through which the mantle air flows axially, can be axially shifted by means of several spindles 16 and the crank or hand wheel 17. The mantle-air passage 18 is connected with the combustion chamber by means of the coincally expanding main burner outlet or discharge 7. The twist blade ring or impeller 15 and the conical burner discharge 7 assure the formation of a back flow zone which enhances the ignition of the main burner. The main burner discharge 7 is made, for example, of a ceramic mass, and is installed in a tubular basket 19 which is formed from the tubes of the wall tubing of the combustion chamber.

The present invention concerns the manner of operation of a coal-dust ignition or pilot burner, and relates to a method of igniting the coal-dust pilot burner flame having an internal back flow region, with the ignition energy being introduced centrally into the internal back flow region of the coal-dust annular burner flame by means of an ignited dust-ignition flame. The invention is characterized primarily by a combination of the following features, including:

(a) the dust-ignition flame is operated with a fuel dust which differs from the main fuel in granular size and/or consistency;

(b) the dust-laden air/dust weight ratio for the dust-ignition flame is smaller (0.5 to 1.0) than that of the main burner flame (1.5 to 2.0);

(c) the dust-ignition flame is operated with a smaller air number ($\lambda=0.8$ to 1.1) than that of the main burner flame ($\lambda=1.1$ to 1.3);

(d) the dust-ignition flame has combustion air supplied thereto by way of the core-air channel of the main burner.

The foregoing method may be further characterized in that the axial combustion-air component for the dust-ignition flame is smaller than that of the main burner flame.

The method of the foregoing paragraphs may be yet further characterized in that the tangential combustion-air component for the dust-ignition flame is greater than that of the main burner flame.

The present invention relates to a method for igniting a pulverized coal annular burner flame with an internal back flow region with which the ignition energy is introduced centrally into the internal back flow region of the pulverized coal annular burner flame according to the foregoing disclosure.

The foregoing proposes that the dust-laden air/dust weight ratio for the dust-ignition flame be smaller (0.5 to 1.0) than that of the main burner flame (1.5 to 2.0). It was furthermore proposed that the dust-ignition flame be operated with a smaller air number or coefficient ($\lambda=0.8$ to 1.1) than that of the main burner flame ($\lambda=1.1$ to 1.3).

It has been shown in practice that the method originally described also can be carried out with smaller values than in the aforementioned procedure.

It is therefore a further object of the present invention to expand the originally disclosed method to include these smaller ranges.

Consequently, the method of the present invention may be further characterized in that the dust-laden air/dust weight ratio for the dust-ignition flame be 0.2 to 0.5, while the dust-laden air/dust weight ratio for the main burner flame be 1.5 to 2.0.

It is further proposed that the dust-ignition flame be operated at an air number or coefficient of $\lambda=0.4$ to 0.8, and that the flame take or draw the additional air flow needed for complete combustion from the leakage or overflow air of the main burner.

In summary, there is provided a method for igniting a coal-dust or pulverized coal annular burner flame with an internal back flow region with which the ignition energy is introduced centrally into the internal back flow region of the coal-dust annular burner flame, whereby the dust-laden air/dust-weight ratio for the dust ignition flame amounts to a value and range of 0.2 to 0.4, whereby the dust-laden air/dust-weight ratio for the main burner flame amounts to a value in a range of 1.5 to 2.0 and whereby the dust ignition flame is operated with an air factor of $\lambda=0.4$ to 0.8 and the additional air flow or stream necessary for the complete combustion is taken or drawn from the leakage or overflow air of the main burner.

The present invention is, or course, in no way restricted to the specific disclosure of the specification and drawing, but also encompasses any modifications within the scope of the appended claims.

What we claim is:

1. A method of igniting a coal dust fired main burner wherein the main burner has an internal back flow region and is ignited by a dust-ignition flame introduced through a central core passage, the main burner having air introduced through a main air passage and pulverized solid fuel introduced through a dust conduit wherein the main air passage has an annular section surrounding an annular section of the dust conduit, which annular section of the dust conduit surrounds the central core passage through which the ignition flame is introduced, the method comprising the steps of:

introducing the dust ignition flame centrally into the internal back flow region by injecting it centrally through the central core passage;

utilizing coal dust entrained in air as an ignition fuel with the ratio of dust-laden air to dust for the ignition flame being in the range of 0.2 to 1.0 while the ratio for the burner flame is in the range of 1.5 to 2.0;

burning the ignition flame at a smaller air number than the main burner flame with the air number for the ignition flame being in the range of 0.8 to 1.1 while that of the main flame being in the range of 1.1 to 1.3;

supplying combustion air to the ignition flame by connecting the central core passage to the main air passage, and providing a greater tangential combustion-air velocity component for said dust-ignition flame than for the main burner flame.

2. A method in combination according to claim 1, which includes the step of providing a smaller axial combusion-air velocity component for said dust-ignition flame than for the main burner flame.

3. A method in combination according to claim 1, which includes the step of providing an ignition burner having an igniter which is operated electrically.

4. A method in combination according to claim 1, which includes the step of operating said ignition flame with the same source of fuel used with the main burner.

5. A method in combination according to claim 1, wherein said ratio for said dust-ignition flame is in a range of 0.5 to 1.0.

6. A method in combination according to claim 1, including steps of:

operating with the dust-laden air to dust-weight ratio for the dust ignition flame in a ratio having a range of 0.2 to 0.5.

7. A method in combination according to claim 6, including the steps of:

simultaneously providing an air factor of $\lambda=0.4$ to 0.8 for dust ignition flame operation; and taking the additional air flow necessary for complete combustion from overflow-leakage air of the main burner.

* * * * *

UNITED STATES PATENT AND TRADEMARK OFFICE

CERTIFICATE OF CORRECTION

PATENT NO. : 4,466,363

DATED : August 21, 1984

INVENTOR(S) : Klaus Leikert and Sigfrid Michelfelder

It is certified that error appears in the above-identified patent and that said Letters Patent is hereby corrected as shown below:

Column 5, line 5, before "ratio" insert -- dust-air dust weight --;

line 5, cancel "of dust-laden air to dust";

line 5, before "igni-", insert -- dust --.

Column 6, line 14, cancel "dust-laden air to dust-", and insert -- dust air-dust --.

line 19, cancel "factor" and insert -- number --.

Signed and Sealed this

Eighteenth Day of November, 1986

*Attest:*

DONALD J. QUIGG

*Attesting Officer* *Commissioner of Patents and Trademarks*